US007086259B2

(12) United States Patent
Almoznino

(10) Patent No.: US 7,086,259 B2
(45) Date of Patent: Aug. 8, 2006

(54) PICK RESISTANT LOCK

(75) Inventor: Rami Almoznino, Fair Lawn, NJ (US)

(73) Assignee: Mul-T-Lock Technologies, Ltd., Yavane (IL)

( * ) Notice: Subject to any disclaimer, the term of this patent is extended or adjusted under 35 U.S.C. 154(b) by 0 days.

(21) Appl. No.: 10/517,986

(22) PCT Filed: Jun. 19, 2000

(86) PCT No.: PCT/IL03/00523

§ 371 (c)(1),
(2), (4) Date: Dec. 15, 2004

(87) PCT Pub. No.: WO04/001165

PCT Pub. Date: Dec. 31, 2003

(65) Prior Publication Data

US 2005/0204788 A1 Sep. 22, 2005

(30) Foreign Application Priority Data

Jun. 20, 2002 (IL) ..... 150362

(51) Int. Cl.
*E05B 27/04* (2006.01)

(52) U.S. Cl. ..... 70/359; 70/419; 70/493

(58) Field of Classification Search ..... 70/359, 70/419, DIG. 75, DIG. 23, 421, 493, 358, 70/378, 392, DIG. 22
See application file for complete search history.

(56) References Cited

U.S. PATENT DOCUMENTS

| | | | | |
|---|---|---|---|---|
| 2,111,515 | A * | 3/1938 | Rauh | 70/493 |
| 2,158,501 | A * | 5/1939 | Fitchburg | 70/493 |
| 2,202,329 | A | 5/1940 | Braune | |
| 2,283,489 | A | 5/1942 | Crousore | |
| 2,629,249 | A | 2/1953 | Mendelsohn | |
| 3,762,193 | A | 10/1973 | Hucknall | 70/419 |
| 3,869,889 | A * | 3/1975 | Prahl | 70/419 |
| 4,142,389 | A | 3/1979 | Bahry et al. | 70/359 |
| 4,403,486 | A * | 9/1983 | Miyake | 70/383 |
| 4,577,479 | A | 3/1986 | Widen | 70/419 X |
| 4,856,309 | A * | 8/1989 | Eizen | 70/359 |

(Continued)

FOREIGN PATENT DOCUMENTS

DE 633 753 8/1936

OTHER PUBLICATIONS

International Search Report dated Oct. 10, 2003.

*Primary Examiner*—Lloyd A. Gall
(74) *Attorney, Agent, or Firm*—Nixon & Vanderhye, P.C.

(57) ABSTRACT

An anti-picking cylinder lock including a lock body, a plug defining a keyway, a plurality of telescopic body pin assemblies, each of the telescopic body pin assemblies including an outer body pin and an inner body pin and a plurality of telescopic plug pin assemblies, each of the telescopic plug pin assemblies including an outer plug pin and an inner plug pin, wherein at least one of the outer plug pins and the outer body pins is formed with at least one inner facing recess configured and arranged such that, upon an attempted picking of the lock, a portion of at least one of the inner plug pins and the inner body pins tends to engage the at least one recess, thus causing at least one of the inner plug pins and the inner body pins to move together in at least one direction.

7 Claims, 6 Drawing Sheets

U.S. PATENT DOCUMENTS

| | | | | |
|---|---|---|---|---|
| 5,123,268 | A | 6/1992 | Eizen | 70/359 |
| 5,222,383 | A * | 6/1993 | Fann et al. | 70/358 |
| 5,520,035 | A | 5/1996 | Eizen | 70/358 |
| 5,839,308 | A | 11/1998 | Eizen et al. | 70/358 |
| 5,894,750 | A * | 4/1999 | Liaw | 70/359 |
| 5,966,971 | A * | 10/1999 | Keller | 70/359 |
| 2002/0189309 | A1 * | 12/2002 | Stemmerik | 70/493 |
| 2003/0140668 | A1 * | 7/2003 | Chao | 70/359 |

* cited by examiner

PICK RESISTANT LOCK

REFERENCES TO RELATED APPLICATIONS

This application is the US national phase of international application PCT/IL2003/000523 filed 19 Jun. 2003 which designated the U.S. and claims benefit of Israel Patent Application No. 150,362 filed 20 Jun. 2002, the entire contents of both of which applications are incorporated by reference.

FIELD OF THE INVENTION

The present invention relates to locks generally and more particularly to cylinder locks having telescopic pins.

BACKGROUND OF THE INVENTION

The following US Patents are believed to represent the current state of the art:

U.S. Pat. Nos. 4,142,389; 5,123,268; 5,520,035 and 5,839,308.

SUMMARY OF THE INVENTION

The present invention seeks to provide an improved cylinder lock having telescopic pins.

There is thus provided in accordance with a preferred embodiment of the present invention, an anti-picking cylinder lock including a lock body defining a bore for rotatably accommodating a plug, the lock body having formed therein a plurality of body pin bores, a plug rotatably disposed in the bore, the plug defining a keyway which is adapted to receive a key, the plug having formed therein a plurality of plug pin bores arranged to correspond with the plurality of body pin bores, a plurality of telescopic body pin assemblies disposed at least partially in the plurality of body pin bores, each of the telescopic body pin assemblies including an outer body pin and an inner body pin disposed in a bore formed in the outer body pin and a plurality of telescopic plug pin assemblies disposed at least partially in the plurality of plug pin bores, each of the telescopic plug pin assemblies including an outer plug pin and an inner plug pin disposed in a bore formed in the outer plug pin, characterized in that at least one of the outer plug pins and the outer body pins is formed with at least one inner facing recess configured and arranged such that upon attempted picking of the lock, a portion of at least one of the inner plug pins and the inner body pins tends to engage the at least one recess, thus causing at least one of the inner plug pins and the inner body pins to move together in at least one direction.

Preferably, the at least one recess is formed on an outer plug pin. Alternatively, the at least one recess is formed on an outer body pin.

In accordance with another preferred embodiment, the at least one recess includes a plurality of mutually spaced recesses. Preferably, the at least one recess includes an annular recess defining at least one inner pin engagement shoulder.

In accordance with another preferred embodiment, the portion of at least one of the inner plug pins and the inner body pins includes a protrusion. Alternatively, the portion of at least one of the inner plug pins and the inner body pins includes an annular protrusion. Additionally, the protrusion defines at least one inner recess engagement shoulder.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
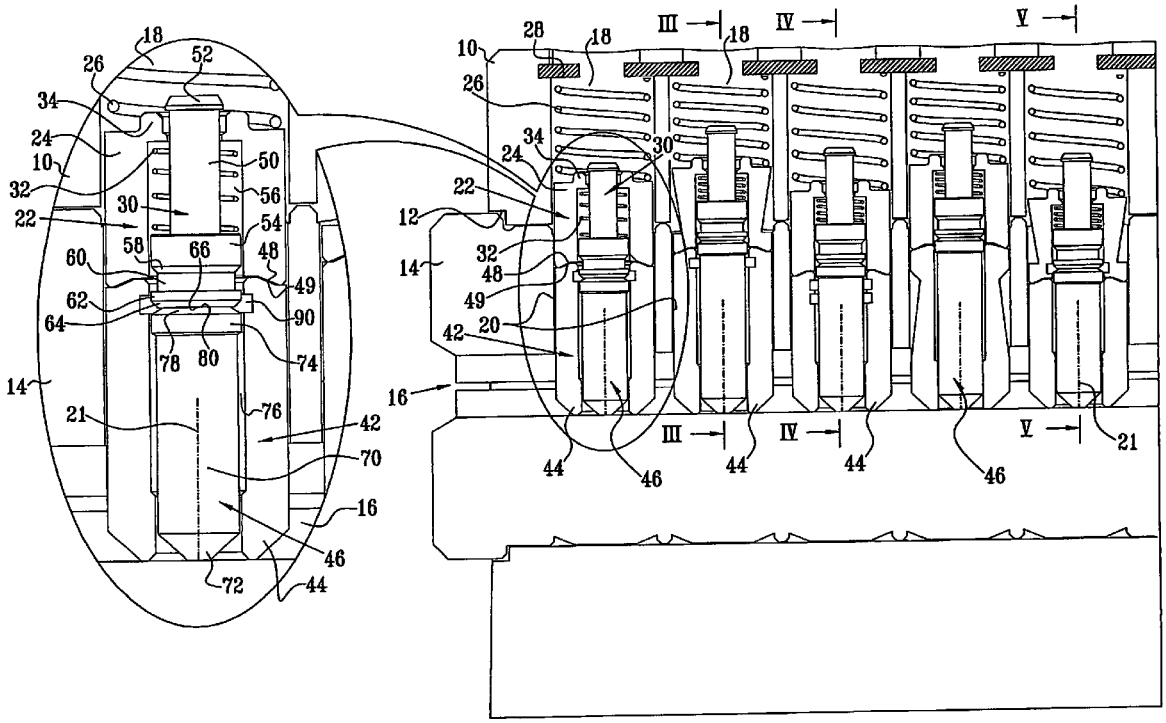
FIGS. 1A and 1B are sectional illustrations of a cylinder lock constructed and operative in accordance with a preferred embodiment of the present invention in respective locked and unlocked operative orientations.
Figure 1B:
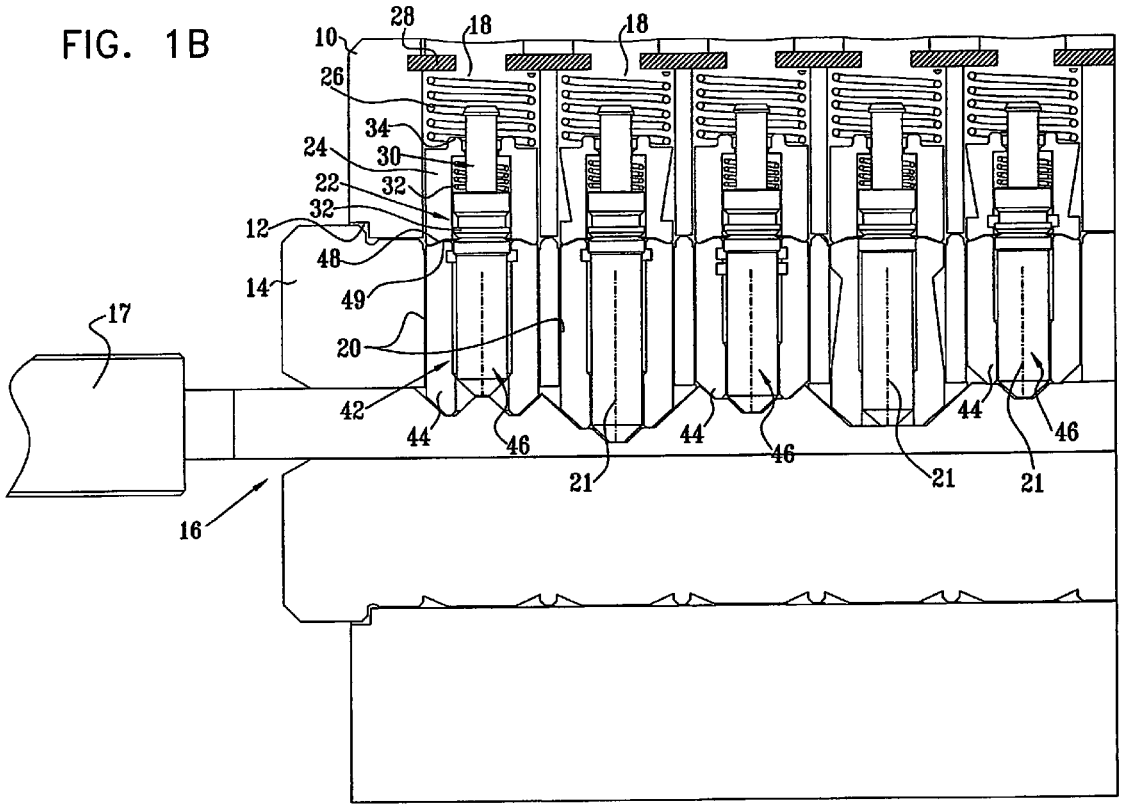

Reference is now made to FIGS. 1A and 1B, which are sectional illustrations of a cylinder lock constructed and operative in accordance with a preferred embodiment of the present invention in respective locked and unlocked operative orientations.

As seen in FIGS. 1A and 1B, there is provided a cylinder lock comprising a lock body 10 defining a bore 12 in which is rotatably disposed a plug 14 defining a keyway 16 which is adapted to receive a key 17 (FIG. 1B). A plurality of body pin bores 18 are formed in lock body 10 and a corresponding plurality of plug pin bores 20, each having a central axis 21, are formed in plug 14, communicating with keyway 16.

Disposed in body pin bores 18 are telescopic body pin assemblies 22, each of which preferably comprises an outer body pin 24, which is spring loaded by a compression coil spring 26, which is seated on a spring seat 28. Disposed interiorly of outer body pin 24 and being linearly displaceable with respect thereto is an inner body pin 30, which is spring loaded relative to outer body pin 24 by a compression coil spring 32, which is seated on a neck portion 34 of the outer body pin 24.

Disposed in plug pin bores 20 are telescopic plug pin assemblies 42, each of which preferably comprises an outer plug pin 44 and, disposed interiorly of outer plug pin 44 and linearly displaceable with respect thereto, an inner plug pin 46. Outer body pin 24 and outer plug pin 44 preferably define respective normally touching engagement surfaces 48 and 49.

As seen in the enlargement of FIG. 1A, the inner body pin 30 preferably comprises a shank portion 50 having a truncated conical head 52 at one end thereof. Formed at an opposite end of shank portion 50 is an enlarged cylindrical portion 54 having a radius which is only slightly less than that of an interior bore 56 in outer body pin 24.

On the opposite side of enlarged cylindrical portion 54 from shank portion 50 is a truncated conical portion 58 which terminates in a narrowed cylindrical portion 60. Adjacent to narrowed cylindrical portion 60 is a second enlarged cylindrical portion 62 typically having the same radius of enlarged cylindrical portion 54 but a thickness which is substantially smaller than enlarged cylindrical portion 54. Inner body pin 30 terminates in a truncated conical portion 64 defining a plug pin engagement surface 66.

The inner plug pin 46 preferably comprises a shank portion 70 having a truncated conical head 72 at one end thereof facing keyway 16. Formed at an opposite end of shank portion 70 is an enlarged cylindrical portion 74 having a radius which is only slightly less than that of an interior bore 76 in outer plug pin 44. On the opposite side of enlarged cylindrical portion 74 from shank portion 70 is a truncated conical portion 78, defining a body pin engagement surface 80.

In accordance with a preferred embodiment of the present invention, an annular recess 90 is formed in an inwardly facing wall of bore 76 adjacent to but not aligned with enlarged cylindrical portion 74. As will be described in detail hereinbelow, this recess is operative to increase the difficulty of picking the telescopic plug pin assembly 42.

In the illustration of FIGS. 1A and 1B, a number of different plug configurations are shown, it being appreciated that similar or different plug configurations may or may not be employed in a given lock.

Figure 2A:
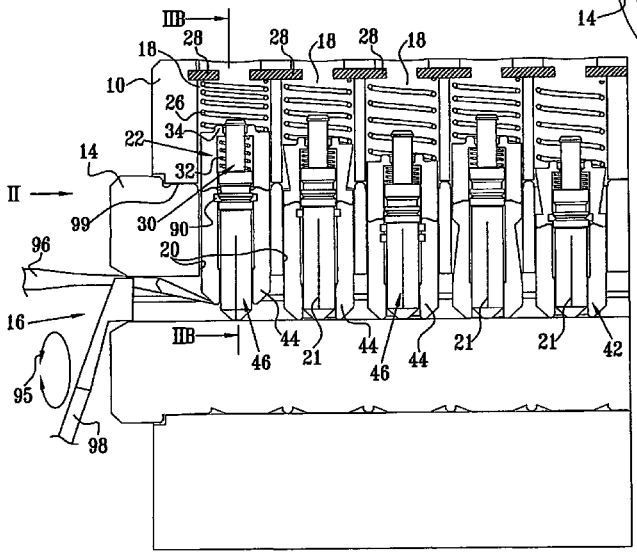
FIGS. 2A and 2B are illustrations of the lock of FIGS. 1A and 1B being picked, FIG. 2A being a sectional illustration and FIG. 2B being a partially end view illustration taken along arrow II in FIG. 2A and a partially sectional illustration taken along lines IIB—IIB in FIG. 2A.
Figure 2A:
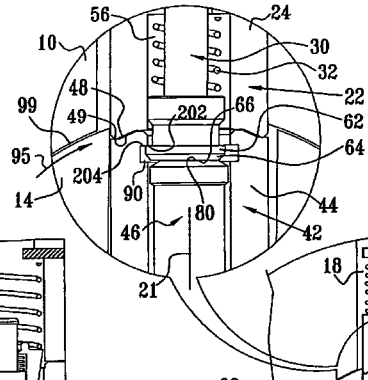
Figure 2B:
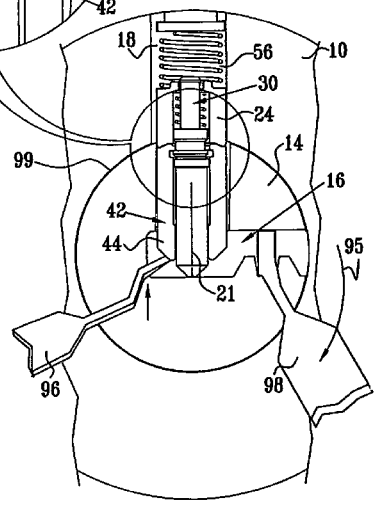

Reference is now made to FIGS. 2A and 2B, which show the lock of FIGS. 1A and 1B being picked in a typical picking situation.

As seen in FIG. 2B a first picking tool 96 is employed to raise outer plug pin 44 while a second picking tool 98 engages the keyway 16 and applies a rotation torque thereto and thus to plug 14 as indicated by arrow 95. It is seen in the enlargement of FIG. 2B that application of torque to plug 14 in the direction of arrow 95 during picking causes the inner body pin 30 to be skewed with respect to interior bore 56 and simultaneous raising of outer plug pin 44 causes second enlarged cylindrical portion 62 and truncated conical portion 64 to be aligned with recess 90. As seen in FIG. 2B, a shoulder 202 of second enlarged cylindrical portion 62 engages a corresponding shoulder 204 of recess 90. This engagement may be useful in causing a person picking the lock to mistakenly assume that he has brought engagement surfaces 48 and 49 of respective outer body and plug pins 24 and 44 to the shear line 99 between the plug 14 and the body 10.

Figure 3A:
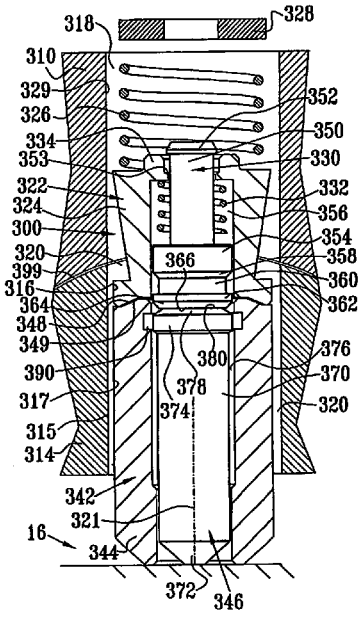
FIGS. 3A, 3B and 3C are sectional illustrations taken along lines III—III in FIG. 1A of a first type of telescopic pin arrangement constructed and operative in accordance with a preferred embodiment of the present invention in respective locked and first and second attempted picking orientations.
Figure 3B:
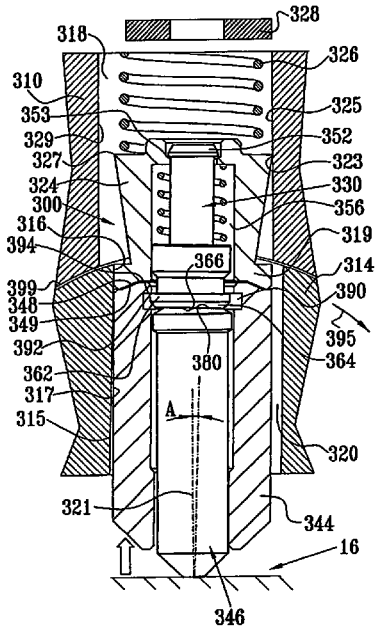
Figure 3C:
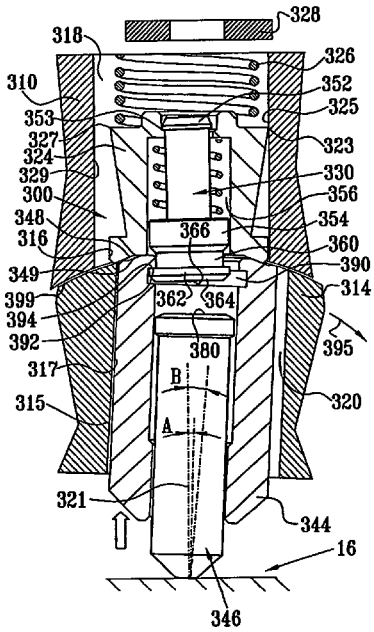

Reference is now made to FIGS. 3A, 3B and 3C, which are sectional illustrations of a first type of telescopic pin arrangement constructed and operative in accordance with a preferred embodiment of the present invention in respective locked and first and second attempted picking orientations. As seen in FIGS. 3A–3C, a telescopic pin assembly 300 is seen disposed partially in a bore 318 of lock body 310 and in a bore 320 of plug 314 and extends partially into keyway 16. The central axis of bore 320 is designated by reference numeral 321.

Telescopic pin assembly 300 preferably includes a telescopic body pin assembly 322, which preferably comprises an outer body pin 324, having a partially conical outer configuration. Outer body pin 324 is spring loaded by a compression coil spring 326, which is seated on a spring seat 328. Disposed interiorly of outer body pin 324 and being linearly displaceable with respect thereto is an inner body pin 330, which is spring loaded relative to outer body pin 324 by a compression coil spring 332, which is seated on a neck portion 334 of the outer body pin 324.

Disposed in plug pin bore 320 is a telescopic plug pin assembly 342, which preferably comprises an outer plug pin 344 and, disposed interiorly of outer plug pin 344 and linearly displaceable with respect thereto, an inner plug pin 346. Outer body pin 324 and outer plug pin 344 preferably define respective normally touching engagement surfaces 348 and 349.

The inner body pin 330 preferably comprises a shank portion 350 having a truncated conical head 352 at one end thereof which is sized so as to have a diameter larger than a corresponding shoulder 353 of outer body pin 324. Formed at an opposite end of shank portion 350 is an enlarged cylindrical portion 354 having a radius which is only slightly less than that of an interior bore 356 in outer body pin 324.

On the opposite side of enlarged cylindrical portion 354 from shank portion 350 is a truncated conical portion 358 which terminates in a narrowed cylindrical portion 360. Adjacent to narrowed cylindrical portion 360 is a second enlarged cylindrical portion 362 typically having the same radius of enlarged cylindrical portion 354 but a thickness which is substantially smaller than enlarged cylindrical portion 354. Inner body pin 330 terminates in a truncated conical portion 364 defining a plug pin engagement surface 366.

The inner plug pin 346 preferably comprises a shank portion 370 having a truncated conical head 372 at one end thereof facing keyway 16. Formed at an opposite end of shank portion 370 is an enlarged cylindrical portion 374 having a radius which is only slightly less than that of an interior bore 376 in outer plug pin 344. On the opposite side of enlarged cylindrical portion 374 from shank portion 370 is a truncated conical portion 378, defining a body pin engagement surface 380.

In accordance with a preferred embodiment of the present invention, an annular recess 390 is formed in an inwardly facing wall of bore 376 adjacent to but not aligned with enlarged cylindrical portion 374. As will be described in detail hereinbelow, this recess is operative to increase the difficulty of picking the telescopic plug pin assembly 342.

FIG. 3B shows a first typical picking situation when, as shown in FIG. 2B, a first picking tool 96 is employed to raise the outer plug pin while a second picking tool 98 engages the keyway 16 and applies a rotation torque thereto and thus to the plug as indicated by arrow 395.

It is seen in FIG. 3B that application of torque to plug 314 in the direction of arrow 395 during picking causes plug 314 to rotate slightly in a clockwise direction as indicated by arrow 395 and as indicated by the clockwise rotation of central axis 321 designated by A. This rotation produces engagement between a clockwise facing wall portion 315 of plug bore 320 with corresponding outer wall portions 316 and 317 of corresponding outer body pin 324 and outer plug pin 344. This engagement pushes a base portion 319 of outer body pin 324 slightly in a clockwise direction causing a clockwise facing edge 323 thereof to engage a corresponding wall portion 325 of bore 318 and increasing the normal separation between an oppositely facing edge 327 of outer body pin 324 from a corresponding wall portion 329 of bore 318, thus skewing outer body pin 324 relative to bore 318.

Skewing of outer body pin 324 relative to bore 318 causes the inner body pin 330 to be skewed with respect to interior bore 356. Simultaneous raising of outer plug pin 344 causes second enlarged cylindrical portion 362 and truncated conical portion 364 to be aligned with recess 390. As seen in FIG. 3B, a shoulder 392 of second enlarged cylindrical portion 362 engages a corresponding shoulder 394 of recess 390. This engagement may be useful in causing a person picking the lock to mistakenly assume that he has brought engagement surfaces 348 and 349 of respective outer body and plug pins 324 and 344 to the shear line 399 between the plug 314 and the body 310.

It is seen in FIG. 3B that truncated conical head 352 is positioned adjacent to and resting upon shoulder 353 of outer body pin 324, FIG. 3C shows a second, further picking situation when the first picking tool 96 (FIG. 2B) is employed to raise the outer plug pin 344 further while the second picking tool 98 (FIG. 2B) continues to engage the keyway 16 and apply a rotation torque thereto and thus to the plug 314 as indicated by arrow 395, producing rotation of the plug 314 as indicated by further clockwise rotation of central axis 321 designated by B.

It is seen in FIG. 3C that further raising of outer plug pin 344 causes outer body pin 324 and inner body pin 330 to be raised together due to the engagement of truncated conical head 352 of inner body pin 330 with shoulder 353 of outer body pin 324. Thus, as seen in FIG. 3C, when the junction between respective normally touching engagement surfaces 348 and 349 of outer body pin 324 and outer plug pin 344 is raised to lie at the shear line 399 between body 310 and plug 314, inner body pin 330 spans the shear line 399, preventing unlocking of the lock.

Furthermore, as seen in FIG. 3C, continued application of torque to plug 314 in the direction of arrow 395 during picking causes plug 314 to rotate further in a clockwise direction as indicated by arrow 395. The resulting engagement between clockwise facing wall portion 315 of plug bore 320 with corresponding outer wall portion 317 of outer plug pin 344 pushes outer plug pin 344 further in a clockwise direction causing full seating of enlarged cylindrical portion 362 of inner body pin 330 in recess 390, engagement of outer plug pin 344 with cylindrical portion 360 of inner body pin 330 and resulting forcing of cylindrical portion 354 of inner body pin 330 clockwise against a facing wall of bore 356 defined by outer body pin 324. The various inner and outer body and plug pins are thus seen to be spatially, axially and angularly offset from each other and locked together as well as being frictionally bound together by forced engagement therebetween, thus rendering picking increasingly difficult.

Figure 4A:
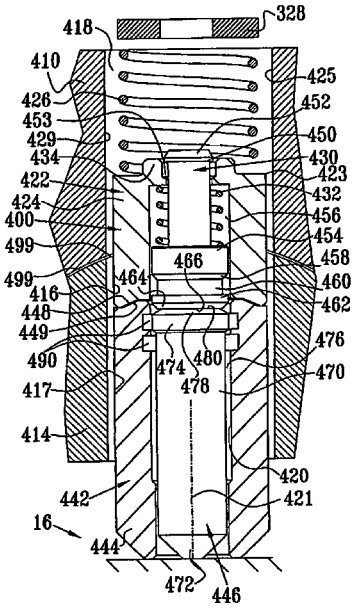
FIGS. 4A, 4B and 4C are sectional illustrations taken along lines IV—IV in FIG. 1A of a second type of telescopic pin arrangement constructed and operative in accordance with a preferred embodiment of the present invention in respective locked and first and second attempted picking orientations.
Figure 4B:
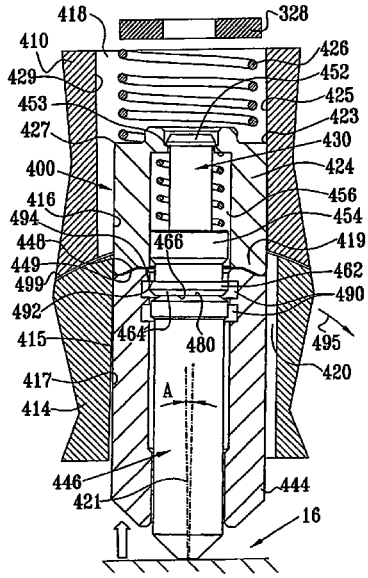
Figure 4C:
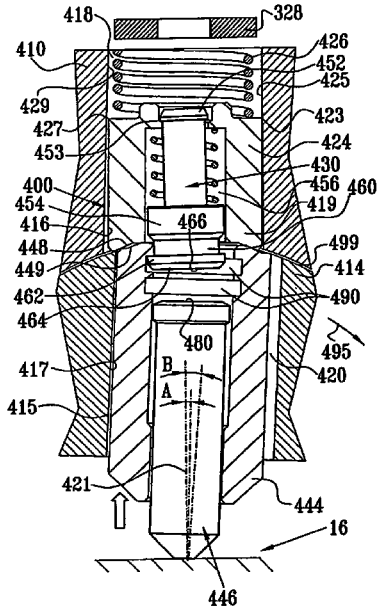

Reference is now made to FIGS. 4A, 4B and 4C, which are sectional illustrations of another type of telescopic pin arrangement constructed and operative in accordance with a preferred embodiment of the present invention in respective locked and attempted picking orientations. As seen in FIGS. 4A–4C, a telescopic pin assembly 400 is seen disposed partially in a bore 418 of lock body 410 and in a bore 420 of plug 414 and extends partially into keyway 16. The central axis of bore 420 is designated by reference numeral 421.

Telescopic pin assembly 400 preferably includes a telescopic body pin assembly 422, which preferably comprises an outer body pin 424, having a partially conical outer configuration. Outer body pin 424 is spring loaded by a compression coil spring 426, which is seated on a spring seat 428. Disposed interiorly of outer body pin 424 and being linearly displaceable with respect thereto is an inner body pin 430, which is spring loaded relative to outer body pin 424 by a compression coil spring 432, which is seated on a neck portion 434 of the outer body pin 424.

Disposed in plug pin bore 420 is a telescopic plug pin assembly 442, which preferably comprises an outer plug pin 444 and, disposed interiorly of outer plug pin 444 and linearly displaceable with respect thereto, an inner plug pin 446. Outer body pin 424 and outer plug pin 444 preferably define respective normally touching engagement surfaces 448 and 449.

The inner body pin 430 preferably comprises a shank portion 450 having a truncated conical head 452 at one end thereof which is sized so as to have a diameter larger than a corresponding shoulder 453 of outer body pin 424. Formed at an opposite end of shank portion 450 is an enlarged cylindrical portion 454 having a radius which is only slightly less than that of an interior bore 456 in outer body pin 424.

On the opposite side of enlarged cylindrical portion 454 from shank portion 450 is a truncated conical portion 458 which terminates in a narrowed cylindrical portion 460. Adjacent to narrowed cylindrical portion 460 is a second enlarged cylindrical portion 462 typically having the same radius of enlarged cylindrical portion 454 but a thickness which is substantially smaller than enlarged cylindrical portion 454. Inner body pin 430 terminates in a truncated conical portion 464 defining a plug pin engagement surface 466.

The inner plug pin 446 preferably comprises a shank portion 470 having a truncated conical head 472 at one end thereof facing keyway 16. Formed at an opposite end of shank portion 470 is an enlarged cylindrical portion 474 having a radius which is only slightly less than that of an interior bore 476 in outer plug pin 444. On the opposite side of enlarged cylindrical portion 474 from shank portion 470 is a truncated conical portion 478, defining a body pin engagement surface 480.

In accordance with a preferred embodiment of the present invention, a pair of mutually spaced annular recesses 490 is formed in an inwardly facing wall of bore 476 adjacent to but not aligned with enlarged cylindrical portion 474. As will be described in detail hereinbelow, these recesses are operative to increase the difficulty of picking the telescopic plug pin assembly 442.

FIG. 4B shows a typical picking situation when, as shown in FIG. 2B, a first picking tool 96 is employed to raise the outer plug pin while a second picking tool 98 engages the keyway 16 and applies a rotation torque thereto and thus to the plug as indicated by arrow 495.

It is seen in FIG. 4B that application of torque to plug 414 in the direction of arrow 495 during picking causes plug 414 to rotate slightly in a clockwise direction as indicated by arrow 495 and as indicated by the clockwise rotation of central axis 421 designated by A. This rotation produces engagement between a clockwise facing wall portion 415 of plug bore 420 with corresponding outer wall portions 416 and 417 of corresponding outer body pin 424 and outer plug pin 444. This engagement pushes a base portion 419 of outer body pin 424 slightly in a clockwise direction causing a clockwise facing edge 423 thereof to engage a corresponding wall portion 425 of bore 418 and increasing the normal separation between an oppositely facing edge 427 of outer body pin 424 from a corresponding wall portion 429 of bore 418, thus skewing outer body pin 424 relative to bore 418.

Skewing of outer body pin 424 relative to bore 418 causes the inner body pin 430 to be skewed with respect to interior bore 456. Simultaneous raising of outer plug pin 444 causes second enlarged cylindrical portion 462 and truncated conical portion 464 to be aligned with one or the other of recesses 490 depending on the relative positions of the outer plug pin 444 and the inner body pin 430. As seen in FIG. 4B, a shoulder 492 of second enlarged cylindrical portion 462 engages a corresponding shoulder 494 of recess 490. This engagement may be useful in causing a person picking the lock to mistakenly assume that he has brought engagement surfaces 448 and 449 of respective outer body and plug pins 424 and 444 to the shear line 499 between the plug 414 and the body 410.

It is seen in FIG. 4B that truncated conical head 452 is positioned adjacent to and resting upon shoulder 453 of outer body pin 424.

FIG. 4C shows a second, further picking situation when the first picking tool 96 (FIG. 2B) is employed to raise the outer plug pin 444 further while the second picking tool 98 (FIG. 2B) continues to engage the keyway 16 and apply a rotation torque thereto and thus to the plug 414 as indicated by arrow 495, producing rotation of the plug 414 as indicated by further clockwise rotation of central axis 421 designated by B.

It is seen in FIG. 4C that further raising of outer plug pin 444 causes outer body pin 424 and inner body pin 430 to be raised together due to the engagement of truncated conical head 452 of inner body pin 430 with shoulder 453 of outer body pin 424. Thus, as seen in FIG. 4C, when the junction between respective normally touching engagement surfaces 448 and 449 of outer body pin 424 and outer plug pin 444 is raised to lie at the shear line 499 between body 410 and plug 414, inner body pin 430 spans the shear line 499, preventing unlocking of the lock.

Furthermore, as seen in FIG. 4C, continued application of torque to plug 414 in the direction of arrow 495 during picking causes plug 414 to rotate further in a clockwise direction as indicated by arrow 495. The resulting engagement between clockwise facing wall portion 415 of plug bore 420 with corresponding outer wall portion 417 of outer plug pin 444 pushes outer plug pin 444 further in a clockwise direction causing full seating of enlarged cylindrical portion 462 of inner body pin 430 in recess 490, engagement of outer plug pin 444 with cylindrical portion 460 of inner body pin 430 and resulting forcing of cylindrical portion 454 of inner body pin 430 clockwise against a facing wall of bore 456 defined by outer body pin 424. The various inner and outer body and plug pins are thus seen to be spatially, axially and angularly offset from each other and locked together as well as being frictionally bound together by forced engagement therebetween, thus rendering picking increasingly difficult.

Figure 5A:
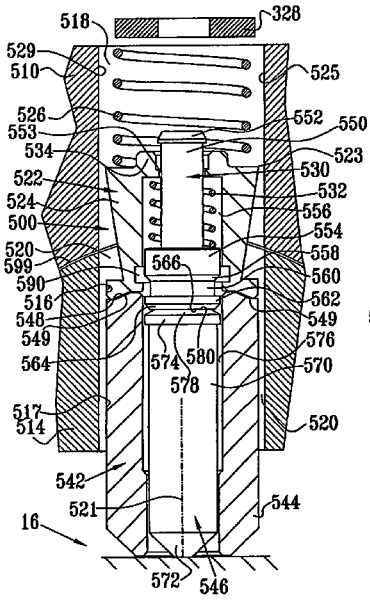
FIGS. 5A, 5B and 5C are sectional illustrations taken along lines V—V in FIG. 1A of a third type of telescopic pin arrangement constructed and operative in accordance with a preferred embodiment of the present invention in respective locked and first and second attempted picking orientations.
Figure 5B:
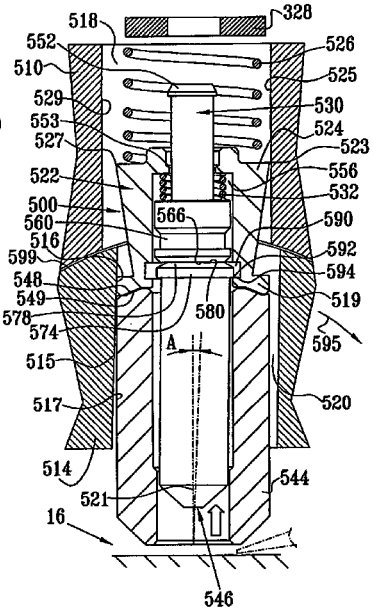
Figure 5C:
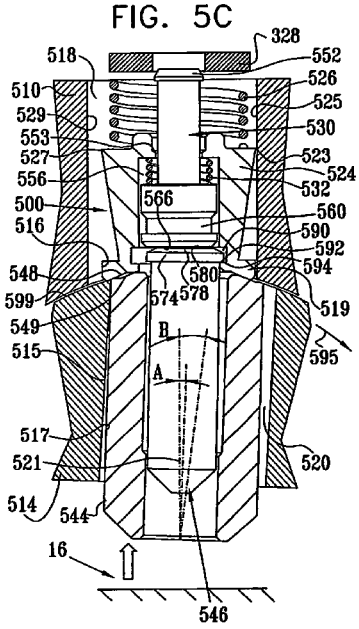

Reference is now made to FIGS. 5A, 5B and 5C, which are sectional illustrations of another type of telescopic pin arrangement constructed and operative in accordance with a preferred embodiment of the present invention in respective locked and attempted picking orientations. As seen in FIGS. 5A–5C, a telescopic pin assembly 500 is seen disposed partially in a bore 518 of lock body 510 and in a bore 520 of plug 514 and extends partially into keyway 16. The central axis of bore 520 is designated by reference numeral 521.

Telescopic pin assembly 500 preferably includes a telescopic body pin assembly 522, which preferably comprises an outer body pin 524, having a partially conical outer configuration. Outer body pin 524 is spring loaded by a compression coil spring 526, which is seated on a spring seat 528. Disposed interiorly of outer body pin 524 and being linearly displaceable with respect thereto is an inner body pin 530, which is spring loaded relative to outer body pin 524 by a compression coil spring 532, which is seated on a neck portion 534 of the outer body pin 524.

Disposed in plug pin bore 520 is a telescopic plug pin assembly 542, which preferably comprises an outer plug pin 544 and, disposed interiorly of outer plug pin 544 and linearly displaceable with respect thereto, an inner plug pin 546. Outer body pin 524 and outer plug pin 544 preferably define respective normally touching engagement surfaces 548 and 549.

The inner body pin 530 preferably comprises a shank portion 550 having a truncated conical head 552 at one end thereof which is sized so as to have a diameter larger than a corresponding shoulder 553 of outer body pin 524. Formed at an opposite end of shank portion 550 is an enlarged cylindrical portion 554 having a radius which is only slightly less than that of an interior bore 556 in outer body pin 524.

On the opposite side of enlarged cylindrical portion 554 from shank portion 550 is a truncated conical portion 558 which terminates in a narrowed cylindrical portion 560. Adjacent to narrowed cylindrical portion 560 is a second enlarged cylindrical portion 562 typically having the same radius of enlarged cylindrical portion 554 but a thickness which is substantially smaller than enlarged cylindrical portion 554. Inner body pin 530 terminates in a truncated conical portion 564 defining a plug pin engagement surface 566.

The inner plug pin 546 preferably comprises a shank portion 570 having a truncated conical head 572 at one end thereof facing keyway 16. Formed at an opposite end of shank portion 570 is an enlarged cylindrical portion 574 having a radius which is only slightly less than that of an interior bore 576 in outer plug pin 544. On the opposite side of enlarged cylindrical portion 574 from shank portion 570 is a truncated conical portion 578, defining a body pin engagement surface 580.

In accordance with a preferred embodiment of the present invention, an annular recess 590 is formed in an inwardly facing wall of bore 556 adjacent to but not aligned with enlarged cylindrical portion 574. As will be described in detail hereinbelow, this recess is operative to increase the difficulty of picking the telescopic plug pin assembly 542.

FIG. 5B shows a typical picking situation when, as shown in FIG. 2B, a first picking tool 96 is employed to raise the outer plug pin while a second picking tool 98 engages the keyway 16 and applies a rotation torque thereto and thus to the plug as indicated by arrow 595.

It is seen in FIG. 5B that application of torque to plug 514 in the direction of arrow 595 during picking causes plug 514 to rotate slightly in a clockwise direction as indicated by arrow 595 and as indicated by the clockwise rotation of central axis 521 designated by A. This rotation produces engagement between a clockwise facing wall portion 515 of plug bore 520 with corresponding outer wall portions 516 and 517 of corresponding outer body pin 524 and outer plug pin 544. This engagement pushes a base portion 519 of outer body pin 524 slightly in a clockwise direction causing a clockwise facing edge 523 thereof to engage a corresponding wall portion 525 of bore 518 and increasing the normal separation between an oppositely facing edge 527 of outer body pin 524 from a corresponding wall portion 529 of bore 518, thus skewing outer body pin 524 relative to bore 518.

Skewing of outer body pin 524 relative to bore 518 causes the inner body pin 530 to be skewed with respect to interior bore 556. Simultaneous raising of inner plug pin 546 causes enlarged cylindrical portion 574 and truncated conical portion 578 to be aligned with recess 590. As seen in FIG. 5B, a shoulder 592 of enlarged cylindrical portion 574 engages a corresponding shoulder 594 of recess 590.

It may be appreciated that lock picking can be done in various ways, is extremely dynamic and may result in any one of a variety of situations. FIG. 5B illustrates only one possible situation in which the picking of inner plug pin 546 results in a clockwise engagement of enlarged cylindrical portion 574 with a corresponding shoulder 594 of recess 590, it being appreciated that other equally or more prevalent situations may occur during picking. This engagement may be useful in causing a person picking the lock to mistakenly assume that he has brought engagement surfaces 548 and 549 of respective outer body and plug pins 524 and 544 to the shear line 599 between the plug 514 and the body 510.

FIG. 5C shows a second, further picking situation when the first picking tool 96 (FIG. 2B) is employed to raise the outer plug pin 544 further while the second picking tool 98 (FIG. 2B) continues to engage the keyway 16 and apply a rotation torque thereto and thus to the plug 514 as indicated by arrow 595, producing rotation of the plug 514 as indicated by further clockwise rotation of central axis 521 designated by B.

It is seen in FIG. 5C that due to the engagement of shoulder 592 of enlarged cylindrical portion 574 with a corresponding shoulder 594 of recess 590, further raising of outer plug pin 544 causes outer body pin 524, inner body pin 530 and inner plug pin 546 to be raised together therewith, thus preventing the junction of respective engagement surfaces 566 and 580 of inner body and plug pins 530 and 546 and the junction of respective engagement surfaces 548 and 549 of outer body and plug pins 524 and 544 from being located at the shear line 599 between the plug 514 and the body 510 at the same time. Thus, as seen in FIG. 5C, when the junction between respective normally touching engagement surfaces 548 and 549 of outer body pin 524 and outer plug pin 544 is raised to lie at the shear line 599 between body 510 and plug 514, inner plug pin 546 spans the shear line 599, preventing unlocking of the lock.

Furthermore, as seen in FIG. 5C, continued application of torque to plug 514 in the direction of arrow 595 during picking causes plug 514 to rotate further in a clockwise direction as indicated by arrow 595. The resulting engagement between clockwise facing wall portion 515 of plug bore 520 with corresponding outer wall portion 517 of outer plug pin 544 pushes outer plug pin 544 further in a clockwise direction causing fall seating of enlarged cylindrical portion 574 of inner plug pin 546 in recess 590 and resulting forcing of base portion 519 of outer body pin 524 clockwise against a facing wall of bore 518 defined by body 510. The various inner and outer body and plug pins are thus seen to be spatially, axially and angularly offset from each other and locked together as well as being frictionally bound together by forced engagement therebetween, thus rendering picking increasingly difficult.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. An anti-picking cylinder lock comprising:

a lock body defining a bore for rotatably accommodating a plug, said lock body having formed therein a plurality of body pin bores;

said plug rotatably disposed in said bore, said plug defining a keyway which is adapted to receive a key, said plug having formed therein a plurality of plug pin bores arranged to correspond with said plurality of body pin bores;

a plurality of telescopic body pin assemblies disposed at least partially in said plurality of body pin bores, each of said telescopic body pin assemblies comprising an outer body pin and an inner body pin disposed in a bore formed in said outer body pin; and a plurality of telescopic plug pin assemblies disposed at least partially in said plurality of plug pin bores, each of said telescopic plug pin assemblies comprising an outer plug pin and an inner plug pin disposed in a bore formed in said outer plug pin, wherein at least one of said outer plug pins is formed with at least one recess configured and arranged such that, upon an attempted picking of said lock, a portion of at least one of said inner body pins tends to engage said at least one recess.

2. An anti-picking cylinder lock according to claim 1 and wherein said at least one recess comprises a plurality of mutually spaced recesses.

3. An anti-picking cylinder lock according to claim 1 and wherein said at least one recess comprises an annular recess engageable with a cylindrical portion of said inner body pin.

4. An anti-picking cylinder lock according to claim 1, wherein when the portion of at least one of said inner body pins is engaged with said at least one recess, said at least one of said outer plug pins and said at least one of said inner body pins move together during said attempted picking.

5. An anti-picking cylinder lock comprising:

a lock body defining a bore for rotatably accommodating a plug, said lock body having formed therein a plurality of body pin bores;

said plug rotatably disposed in said bore, said plug defining a keyway which is adapted to receive a key, said plug having formed therein a plurality of plug pin bores arranged to correspond with said plurality of body pin bores;

a plurality of telescopic body pin assemblies disposed at least partially in said plurality of body pin bores, each of said telescopic body pin assemblies comprising an outer body pin and an inner body pin disposed in a bore formed in said outer body pin; and a plurality of telescopic plug pin assemblies disposed at least partially in said plurality of plug pin bores, each of said telescopic plug pin assemblies comprising an outer plug pin and an inner plug pin disposed in a bore formed in said outer plug pin, wherein at least one of said outer body pins is formed with at least one recess configured and arranged such that, upon an attempted picking of said lock, a portion of at least one of said inner plug pins tends to engage said at least one recess.

6. An anti-picking cylinder lock according to claim 5, wherein when the portion of at least one of said inner plug pins is engaged with said at least one recess, said at least one of said outer body pins and said at least one of said inner plug pins move together during said attempted picking.

7. An anti-picking cylinder lock according to claim 5, wherein said at least one recess comprises an annular recess engageable with a shoulder of said inner plug pin.

* * * * *

UNITED STATES PATENT AND TRADEMARK OFFICE

CERTIFICATE OF CORRECTION

PATENT NO. : 7,086,259 B2
APPLICATION NO. : 10/517986
DATED : August 8, 2006
INVENTOR(S) : Rami Almoznino It is certified that error appears in the above-identified patent and that said Letters Patent is hereby corrected as shown below:

On the title page:

Delete "(22) PCT Filed: Jun. 19, 2000" and insert therefor

-- (22) PCT Filed: Jun. 19, 2003 --

Signed and Sealed this

Twenty-first Day of November, 2006

JON W. DUDAS
*Director of the United States Patent and Trademark Office*